US006276117B1

(12) United States Patent
Wiles

(10) Patent No.: US 6,276,117 B1
(45) Date of Patent: Aug. 21, 2001

(54) ADJUSTABLE POUCH CARRIER FOR DIFFERENT SIZE POUCHES AND PACKAGING MACHINE HAVING AN ADJUSTABLE POUCH CARRIER

(75) Inventor: Jerry Wiles, Sarasota, FL (US)

(73) Assignee: Klockner Bartelt, Sarasota, FL (US)

( * ) Notice: Subject to any disclaimer, the term of this patent is extended or adjusted under 35 U.S.C. 154(b) by 0 days.

(21) Appl. No.: 09/312,677

(22) Filed: May 17, 1999

(51) Int. Cl.[7] ..... B65B 43/26
(52) U.S. Cl. ..... 53/570; 53/384.1
(58) Field of Search ..... 53/201, 492, 384.1, 53/570, 564, 562

(56) References Cited

U.S. PATENT DOCUMENTS

| | | | | |
|---|---|---|---|---|
| 2,649,674 | | 8/1953 | Bartelt . | |
| 2,716,795 | | 9/1955 | Harker . | |
| 2,745,583 | | 5/1956 | Harker . | |
| 3,269,524 | | 8/1966 | Canfield . | |
| 3,340,679 | * | 9/1967 | Johnson | 53/570 |
| 3,430,414 | | 3/1969 | Ludwig et al. . | |
| 3,553,934 | * | 1/1971 | Johnson et al. | 53/562 |
| 3,568,402 | | 3/1971 | Lense et al. . | |
| 4,263,768 | | 4/1981 | Russell et al. . | |
| 4,423,583 | | 1/1984 | Carey . | |
| 4,580,473 | | 4/1986 | Seiden et al. . | |
| 5,862,653 | * | 1/1999 | Solano | 53/562 |
| 6,050,061 | * | 4/2000 | Todd et al. | 53/562 |

* cited by examiner

*Primary Examiner*—Stephen F. Gerrity
(74) *Attorney, Agent, or Firm*—Leydig, Voit & Mayer, Ltd.

(57) ABSTRACT

An endless carrier for a packaging machine includes leading clamps which are mounted on one endless chain and trailing clamps which are mounted on another endless chain. The chains are independent of each other such that the distance between trailing clamps and leading clamps can be adjusted simply by moving the position of one chain relative to the other. The present invention may be incorporated in a newly built packaging machine or a retrofit kit for replacing the endless carrier of a preexisting packaging machine. To provide for ready adaptation of the distance between leading and trailing clamps, one of the sprockets connected to the drive shaft of the packaging machine can be a phase sprocket capable of being fastened and unfastened to the drive shaft such that the chain can be rotated simply by rotating the sprocket relative to the drive shaft to reposition the endless chain relative to the other endless chain. Various components in the intermittent drive mechanism of the packaging machine may also be replaced to maintain a high speed of the packaging machine.

18 Claims, 14 Drawing Sheets

32
50
48
76
78
122
60
124
120
22
64
124
62
26
28
57
24
54
43
45
55
20

ADJUSTABLE POUCH CARRIER FOR DIFFERENT SIZE POUCHES AND PACKAGING MACHINE HAVING AN ADJUSTABLE POUCH CARRIER

FIELD OF THE INVENTION

The present invention generally relates to a pouch filling section of a packaging machine, and more specifically to a pouch filling section of a packaging machine which includes an endless carrier having pairs of leading and trailing clamps for holding pouches therebetween.

BACKGROUND OF THE INVENTION

Modern packaging machines typically comprise an upstream pouch making section where pouches are made and a downstream pouch filling section where pouches are opened, filled with material and then typically sealed or otherwise closed. The pouch filling section includes an endless carrier which typically comprises an endless chain that picks the pouches from the pouch making section, advances the pouches through various stations in order to fill the pouch with material and then drops off the filled pouch. Although continuous motion type packaging machines driven by a continuous drive mechanism have been provided by the prior art, intermittent type packaging machines have been more common. Intermittent type packaging machines advance the pouch intermittently or step-by-step in which the pouch forming, filling and sealing operations take place when the pouches dwell between successive steps. The success and durability of intermittent type packaging machines is evidenced by the large number of older intermittent packaging machines still in use today (some machines dating back over 30 or 40 years).

In the past, the pouches were typically constructed from relatively rigid materials such as heavy paper or foil. The material was sufficiently rigid such that the pouch when opened maintained an open shape when only held at one end. As such, many of the endless carriers of prior packaging machines typically only hold the pouch with one clamp such as those disclosed for example in U.S. Pat. Nos. 4,580,473, 2,745,583 and 2,649,674. With these prior machines, changing the size or width of the pouch does not require modifications of the endless carrier.

However, with advances in material technology, more modern type pouches are typically made from more flexible materials such as plastic. The pouches are not capable or not as capable of maintaining an open shape for filling and sealing operations. These modern pouches require the need for leading and trailing clamps for holding pouches therebetween, details of examples can be had to U.S. Pat. Nos. 3,568,402, 3,430,414, 4,423,583, and 3,269,524. The leading clamp holds the leading edge of the pouch while the trailing clamp holds the trailing edge of the pouch. To open the pouch, one of the clamps is movable relative to the endless chain and toward the other clamp to provide enough slack such that the bag may be opened. A common way of opening the pouch (for both the single clamp and leading/trailing clamp endless carriers) has been to use a vacuum mechanism which pulls the sides of the pouch apart at the filling station. Thus, two operations are performed at the filling station to first open the pouch and then fill the pouch with the desired material.

While the utilization of leading and trailing clamps has reliably supported and opened the pouches, packaging machines that use leading and trailing clamps have not been able to accommodate different sizes of pouches. A packaging machine is typically dedicated to only one width size of pouch dictated by the distance between leading and trailing clamps. Therefore a complete retooling of the packaging machine is necessary to accommodate a new width size of pouch. Therefore, product packagers have not been readily or easily able to change the size of the pouch. This also requires product packagers to have several differently configured machines for different package sizes for their product lines.

Another concern of product packagers is maintaining a high rate of production which therefore requires an index cycle rate which minimizes the dwell time during each successive step and the time for advancing the pouches between steps. As a practical matter, the dwell time must be long enough to provide sufficient time to perform each of the steps at each of the stations. In prior machines, the dwell time is often limited by the rate at which pouches are filled at the filling station. In any event, it is desirable to both minimize the necessary dwell time and maintain the dwell time as close as possible to the required dwell time for performing the various steps at the stations during each dwell.

SUMMARY OF THE INVENTION

It is therefore an objective of the present invention to provide a packaging machine which can be more readily adapted for holding different sizes of pouches.

It is another objective of the present invention to provide an adjustable pouch carrier which can be readily adapted for holding different sizes of pouches.

In achieving the above objectives, it is a further objective to provide a high production rate for the packaging machine.

It is another objective of the present invention according to one aspect to retrofit or retool an existing packaging machine having pre-existing drive components and filling stations while achieving the above objectives.

Accordingly, the present invention is directed towards an endless carrier for a packaging machine in which leading clamps are mounted on one endless chain and trailing clamps are mounted on another endless chain. The chains are independent of each other such that the distance between each of the trailing clamps and leading clamps can be adjusted simply by moving the position of one chain relative to the other. The present invention may be incorporated in a newly built packaging machine, or a retrofit kit and method for retooling the carrier of a pre-existing packaging machine. The later saves expense with regard to the drive components, frame and other fill section machinery. It is an advantage that a packaging machine incorporating the present invention can be readily adapted for many different width sizes of pouches simply by changing the respective position of the chains without massive retooling and the substantial downtime that is typically associated therewith.

The endless chains can be driven by the same drive mechanism. The drive mechanism operates one of two support shafts which each carry sets of upper and lower sprockets. One of the endless chains is entrained around the upper sprockets and the other endless chain is entrained around the lower sprockets. According to an aspect of the present invention, one of the sprockets of the drive shaft is a "phase sprocket" which can be released from the shaft, rotated to the desired position and resecured to shaft to thereby selectively change the relative position between the endless chains.

According to another aspect of the present invention, continuous chain guides for the respective chains are provided along the path of the pouches such that the chain guides sufficiently support the clamps and pouches for filling section operations.

According to another aspect of the present invention relating to packaging machines of the intermittent-type, the drive mechanics and specifically the cam of the intermittent drive mechanism which drive the endless carrier be optimized to maintain a relative high production rate of the packaging machine. In a retrofit kit the cam of the intermittent drive mechanism is replaced with a new cam having a larger phase, to thereby provide a relatively high production rate of the retrofitted machine. The gearing of the output is also selectively changed.

Other object and advantages of the invention will become more apparent from the following detailed description when taken in conjunction with the accompanying drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE PREFERRED EMBODIMENT

As shown in FIGS. 1–6, the invention is embodied in a packaging machine 20 for filling and sealing substantially flat pouches 22 made from flexible material. For purposes of illustration, much of the actual packaging machinery has not been illustrated in order to better show the various features of the present invention according to the preferred embodiment. The specific machine has been illustrated herein as the intermittent motion type in that the pouches are advanced step-by-step through the various stations of the machine and dwell in the stations during the performance of packaging and filling operations. FIGS. 1–6 generally illustrate the filling section 24 of the machine, and it will be understood that the packaging machine 20 may be associated with an upstream pouch forming section such as those disclosed, for example, in either U.S. Pat. Nos. 3,553,934 or 4,580,473, or other pouch supply section.

Figure 5:
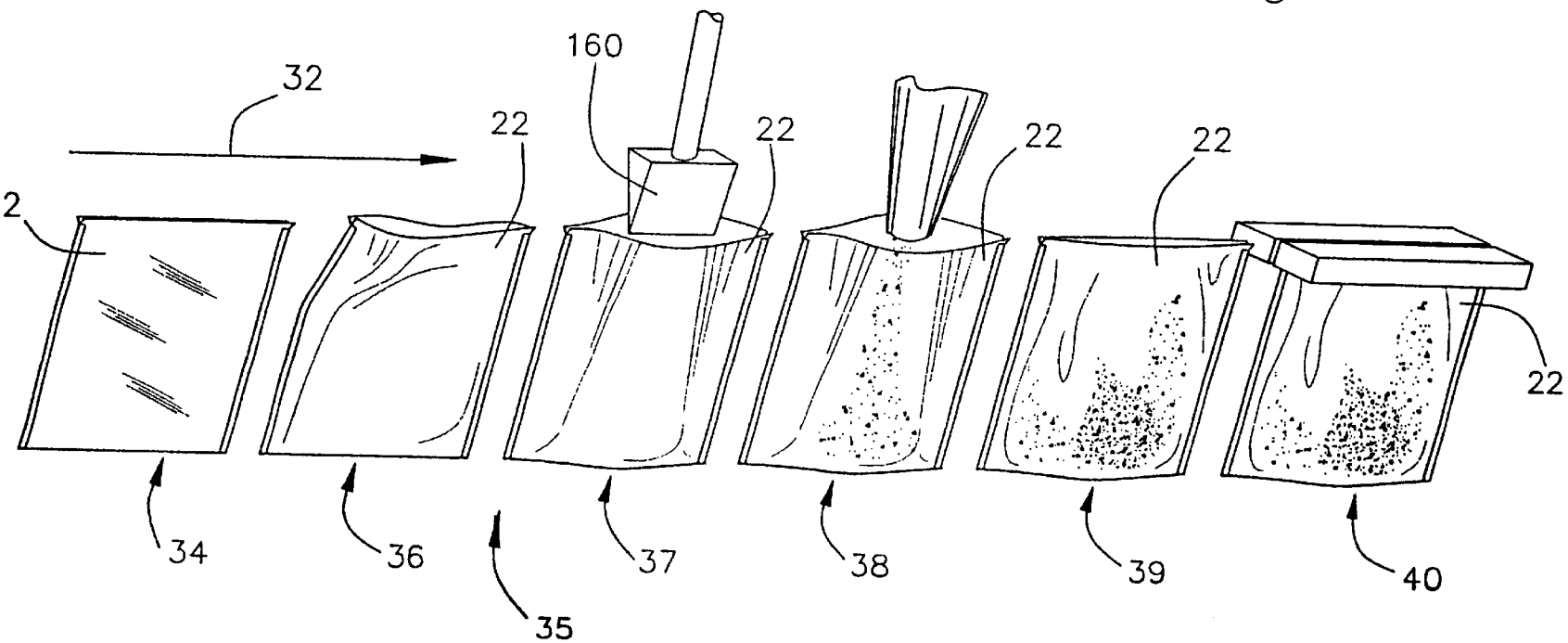
FIG. 5 is a schematic illustration indicating the various steps for filling a pouch according to a preferred embodiment of the present invention utilizing the packaging machine illustrated in FIG. 1.
Figure 6:
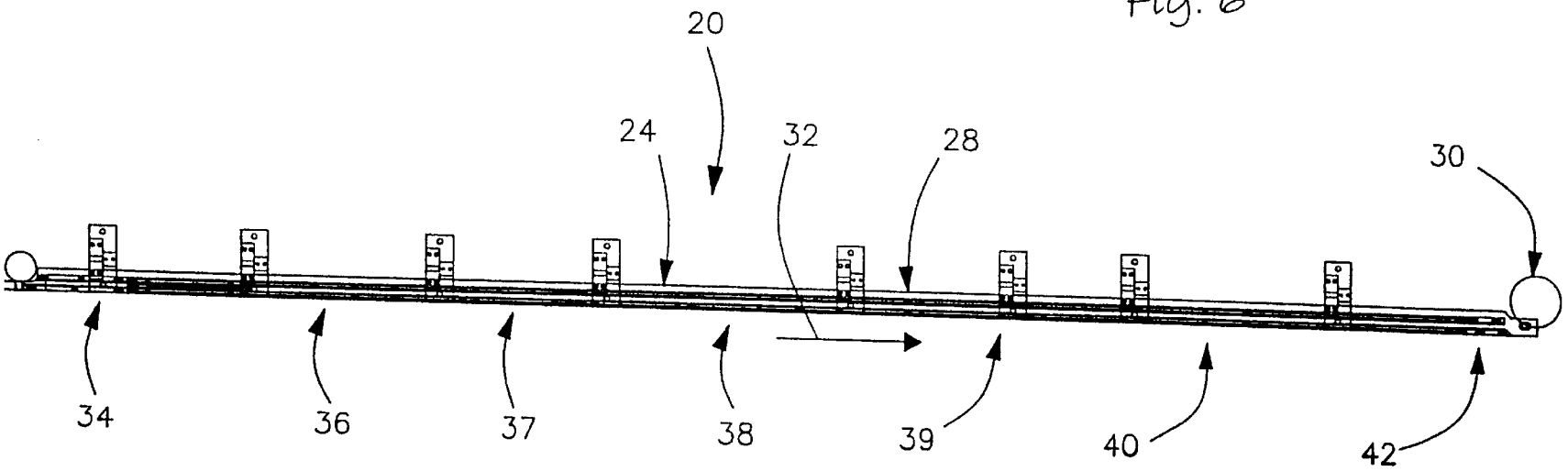
FIG. 6 is a schematic plan view of the entire packaging machine illustrated in FIGS. 1–4.
Figure 8:
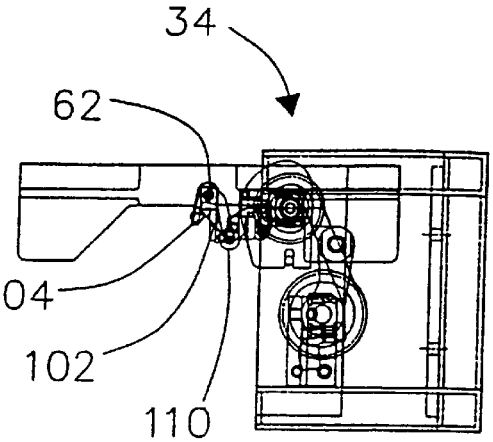
FIGS. 7–9 are end, front elevational and plan views of the pick station located at the end of the packaging machine shown in FIG. 4.
Figure 9:
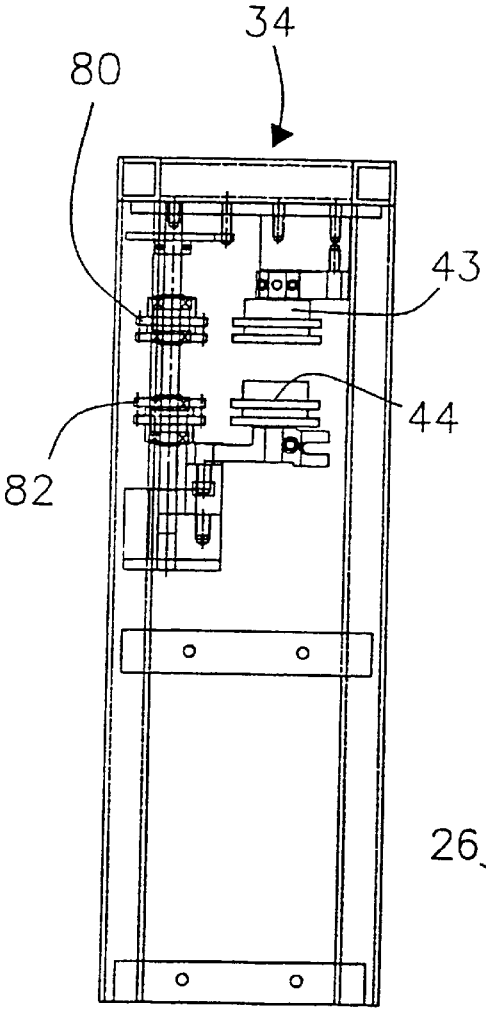
Figure 7:
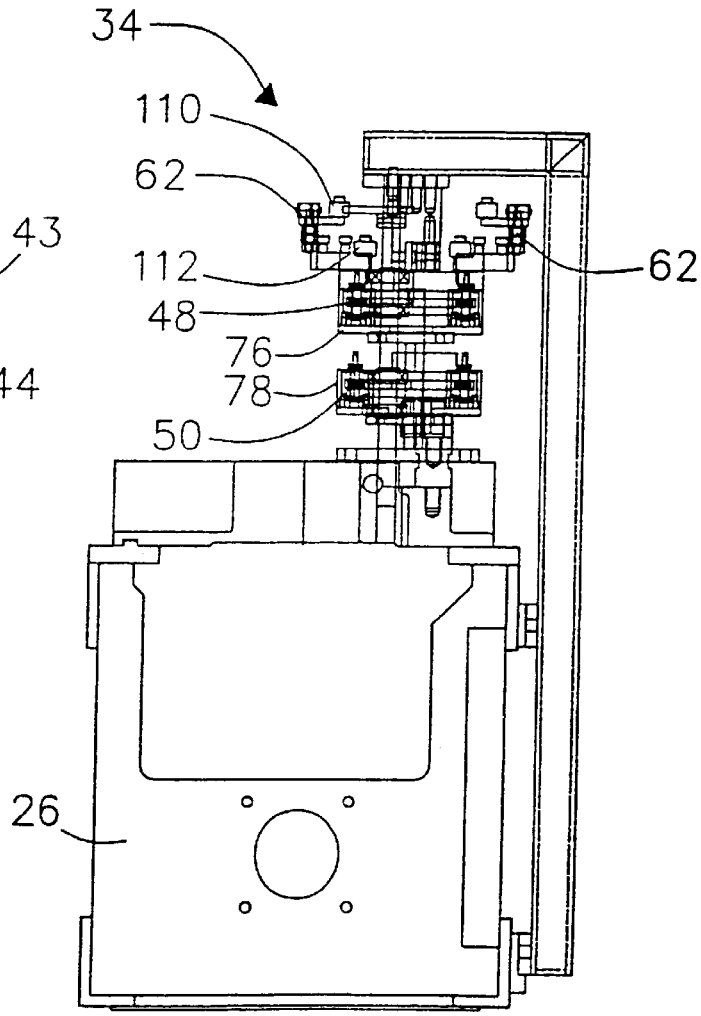
Figure 10:
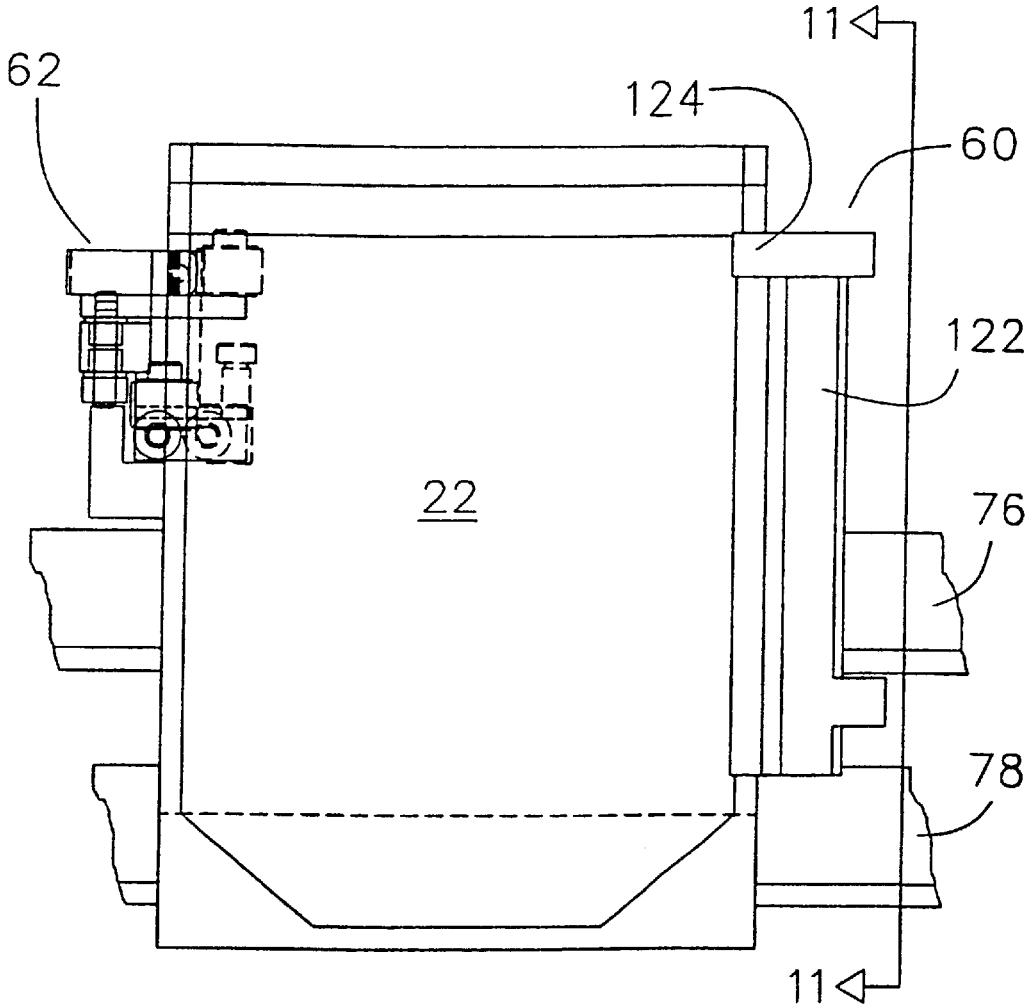
FIG. 10 is a fragmentary side view of the endless carrier holding a pouch of the packaging machine illustrated in FIG. 1.
Figure 12:
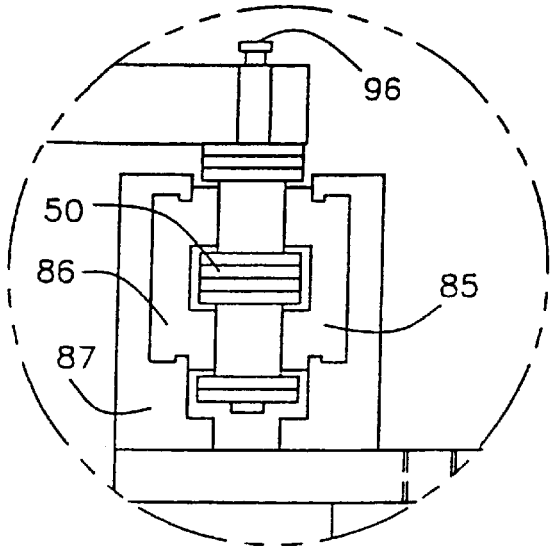
FIG. 12 is an enlarged fragmentary view of a portion of FIG. 11.
Figure 11:
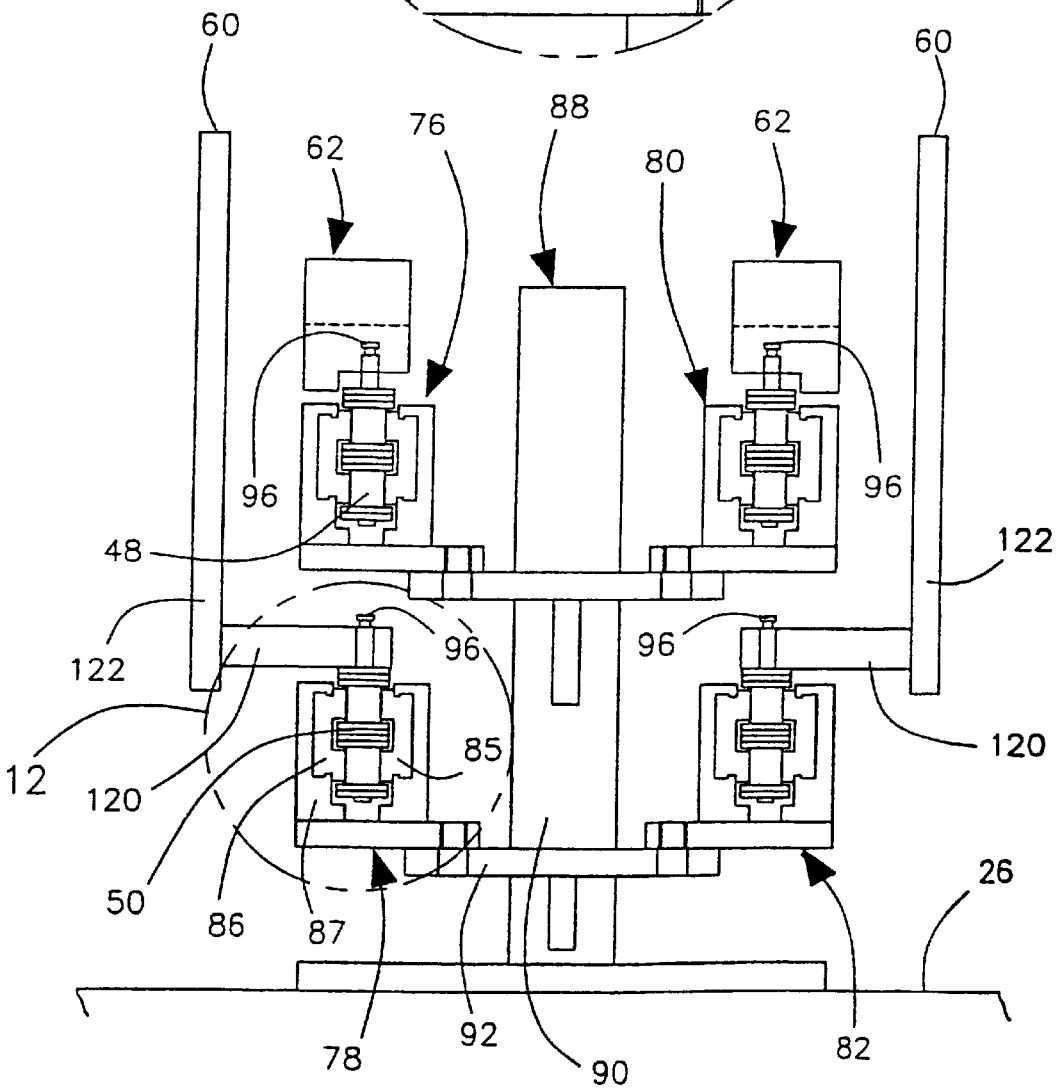
FIG. 11 is a cross-sectional view of FIG. 10 taken about line 11—11.

The machine 20 includes an elongate support frame 26 upon which an endless carrier 28 is mounted for movement along an endless path relative thereto. The endless carrier 28 is intermittently driven by an intermittent drive 30 (sometimes referred to as a Ferguson Drive Mechanism) to index the pouches 22 along a predetermined path 34 represented by arrows in the figures. It will be understood that the present invention may also be incorporated into a packaging machine which is of the continuous type having a continuous drive mechanism. The intermittent drive 30 has a continuous rotational input provided by a cycle shaft 33 and an intermittent output provided on a drive shaft 52. For each rotation of the cycle shaft 33, the endless carrier 28 is indexed one position via the intermittent motion imparted to the drive shaft 52. The time between intermittent outputs is generally referred to as the dwell time at which various operations are performed on the pouches at various stations along the endless carrier 28. In sequential operation and referring to the schematic illustration of FIGS. 5–6 schematically illustrating the preferred embodiment, the endless carrier 28 generally picks up newly formed or otherwise supplied pouches at a pick station 34, opens the pouches at an opening station 35 (which includes a clamp distance shortening station 36 and a wedge forming station 37), fills the pouches with the desired material at a fill station 38, seals or otherwise closes the pouches at a closing station 39, seals the pouches at a seal station 40 and drops off the sealed and filled pouches at a drop station 42. During the dwell time in which the pouches are stationary and at respective stations, the cycle shaft is operating machinery at each of the stations to accomplish the necessary work at the stations that is schematically indicated in FIG. 5. The actual configuration and types of mechanisms used at the stations is well known and can be adapted for the particular type of filling operation. Further details of some of the examples of these stations and various types of mechanisms at these stations are disclosed in the various patents referenced herein, further details of such mechanisms and stations can be had to these references.

The endless carrier 28 generally includes a set of upper sprockets 43, 44, a set of lower sprockets 45, 46, and upper and lower endless chains 48, 50. The upper and lower sprockets 43, 46 are carried by support shafts 52, 54. The support shaft which is drivingly connected to the intermittent drive mechanism 30 is referred to as a drive shaft 52 as it imparts motion to the endless carrier 28. The sprockets 44, 46 are secured to the drive shaft 52 such that they rotate with the drive shaft 52. The drive shaft 52 is journalled in upper and lower bearings 56, 58 mounted in proximity to an end of the frame 26 to provide for smooth rotation of the sprockets 44, 46 relative to the frame 26. The sprockets 43, 45 of the other support shaft 54 are mounted in bearings 55, 57 to the support shaft 54 such that the sprockets 43, 45 can rotate smoothly relative to the frame 26. The upper endless chain 48 is entrained around the set of upper sprockets 43, 44 and the lower endless chain 50 is entrained around the set of lower sprockets 45, 46. The upper and lower sprockets 44, 46 associated with the drive shaft 52 are of the same effective diameter and are securely attached to the drive shaft 52 such that during normal operation of the packaging machine 20 the upper and lower endless chains 48, 50 move in unison and at the same speed to advance the pouches 20 along the path 32.

In accordance with an aspect of the present invention, the preferred embodiment includes pairs of leading clamps 60 which are mounted on one endless chain and trailing clamps 62 which are mounted on another endless chain. (For purposes of illustration, in FIG. 1 each of the clamps are illustrated whereas in FIGS. 3–4 only one pair of clamps is illustrated holding an exemplary pouch, and in FIG. 2 only clamp mounting posts 96 on the endless chains 48, 50 are illustrated to indicate the positions of the clamps). Each of the clamps 60, 62 are suitable for holding an edge of a pouch. In the currently preferred embodiment, the trailing clamps 62 are secured to the upper endless chain 48 while the leading clamps 60 are secured to the lower endless chain 50. The spacing 64 between each pair of adjacent leading and trailing clamps 60, 62 determines the size of pouch that can be currently used by the packaging machine 20.

In accordance with the present invention, one of the endless chains is movable with regard to the other chain to adjust the spacing 64 between adjacent leading and trailing clamps 60, 62 and therefore the size of the pouch to be used by the packaging machine. By advancing or retracting one of the endless chains relative to the other, the spacing 64 between each pair of leading and trailing clamps 60, 62 is simultaneously and properly adjusted thereby minimizing downtime necessary for reconfiguring the machine. The distance the chain is moved corresponds equally to the distance difference in the clamp spacing 64. Since each type of clamp is connected to only one of the endless chains, advancing one of the endless chains only affects the position of one type of the clamps.

In accordance with another aspect of the present invention, at least one f the sprockets can be released from the drive shaft 52 such that it may be loosened or unsecured and then rotated as desired and finally resecured to the drive shaft 52, thereby to move one of the endless chains relative to the other to a selected position. This modifies the spacing 64 between clamps 60, 62 such that the packaging machine 20 is adjustable to readily accommodate many different sizes of pouches without the need for massive retooling of the machine. To accomplish the foregoing, the upper sprocket 44 mounted on the drive shaft 52 is a phase sprocket which includes a movable hub 66 that includes the teeth driving the chain and a fixed hub 68 which is securely fixed to the shaft 52. In the preferred embodiment, the movable hub 66 is fastened to the fixed hub 68 by fasteners 70 which can be loosened to allow for the movable hub 66 to be rotated relative to the fixed hub 68. Once the movable hub 66 of the upper sprocket 44 is rotated to the selected position as desired, the movable hub 66 is refastened to the fixed hub 68 so that that the spacing 64 between pairs of leading and trailing clamps 60, 62 is set for the desired size of pouch. Advantageously, this allows for quick changeover between different pouch sizes, minimizing the amount of labor and time necessary for switching between pouch sizes and the amount of machine downtime associated therewith. Thus, the phase sprocket or other selectively movable sprocket provides an adjustment mechanism for the endless chain. Other less preferred adjustment mechanisms such as a selectively detachable link in one of the endless chains which can be removed to release one of the chains from one of the sprockets could also plausibly be used but would result in a more laborious chain repositioning.

To support the chains, the clamps, and the pouches, (particularly when filled with material) the preferred embodiment includes an upper chain guide 72 for the upper endless chain 48 and a lower chain guide 74 for the lower endless chain 50. Along the front or pouch advancing side of the endless chains, the chain guides 72, 74 have elongate single continuous front guide portions 76, 78 extending through and into each of the stations 34–42 and in proximity to respective ends of the filling section 24 of the packaging machine 20. Along the return side of the endless chains, the chain guides 72, 74 are non-continuous or broken up into spaced apart but aligned sets of guide segments 80, 82. The front guide portions 76, 78 provide adequate support to the respective endless chains 48, 50 to maintain the respective clamps 60, 62 in substantially upright positions sufficiently so that the operations at the various packaging stations 34, 42 are uniformly performed to result in properly opened, filled and sealed pouch packages. Advantageously, this prevents spillage of material from the pouches and ensures properly sealed pouches. The continuous nature of the front guide portions 76, 78 prevents most bending or twisting in the endless chains 48, 50 as a result the clamps only being cantilevered or secured to one of the chains. In particular, the upper front guide portion 76 carries the entire weight of the trailing clamps 62 and partially the weight of the pouch (and any material therein) carried by the trailing clamps 62. Likewise, the lower front guide portion 78 carries the entire weight of the leading clamps 60 and partially the weight of the pouch (and any material therein) carried by the leading clamps 60. Along the return side of the endless carrier 28, twisting or bending of the chains is more permissible thereby allowing for short guide segments 80, 82 for support of the chains and clamps.

Each of the chain guides 72, 74 generally includes an outer support housing which includes spaced apart parallel housing sides 85, a bottom side 87 and chain guide bushings 86 mounted between the sides 85, 87. Between the bushings 86, there is provided a path which closely receives the endless chain closely therethrough. The inner surface of the bushings 86 is contoured closely to that of the endless chains to ensure close retention of the endless chain running through the bushings 86. The bushings 86 are spaced apart to contact the chains at several points for direct transfer of horizontal and vertical loads. The housing sides 85, 87 comprise rigid support material such as metal while the guide bushings 86 comprises a low friction high wear material such as relatively rigid plastic material. The front and return portions of the chain guides 72, 74 are supported by a support structure in the form of a center support trees 88 supported by the support frame 26 of the packaging machine 20. Each support tree 88 includes a central vertical support member 90 between the front and rear portions of the chain guides 72, 74. The support tree 88 is fastened to the support frame 26 at locations generally between packaging stations or in a location that otherwise does not interfere with moving components of the various packaging stations. Horizontal support members 92 extend laterally outward from the vertical support member 90 to support the front chain guide portions 76, 78 and the individual guide segments 80, 82 on the return side. The housings of the chain guides 72, 74 are fastened to the horizontal support members 92.

Figure 1:
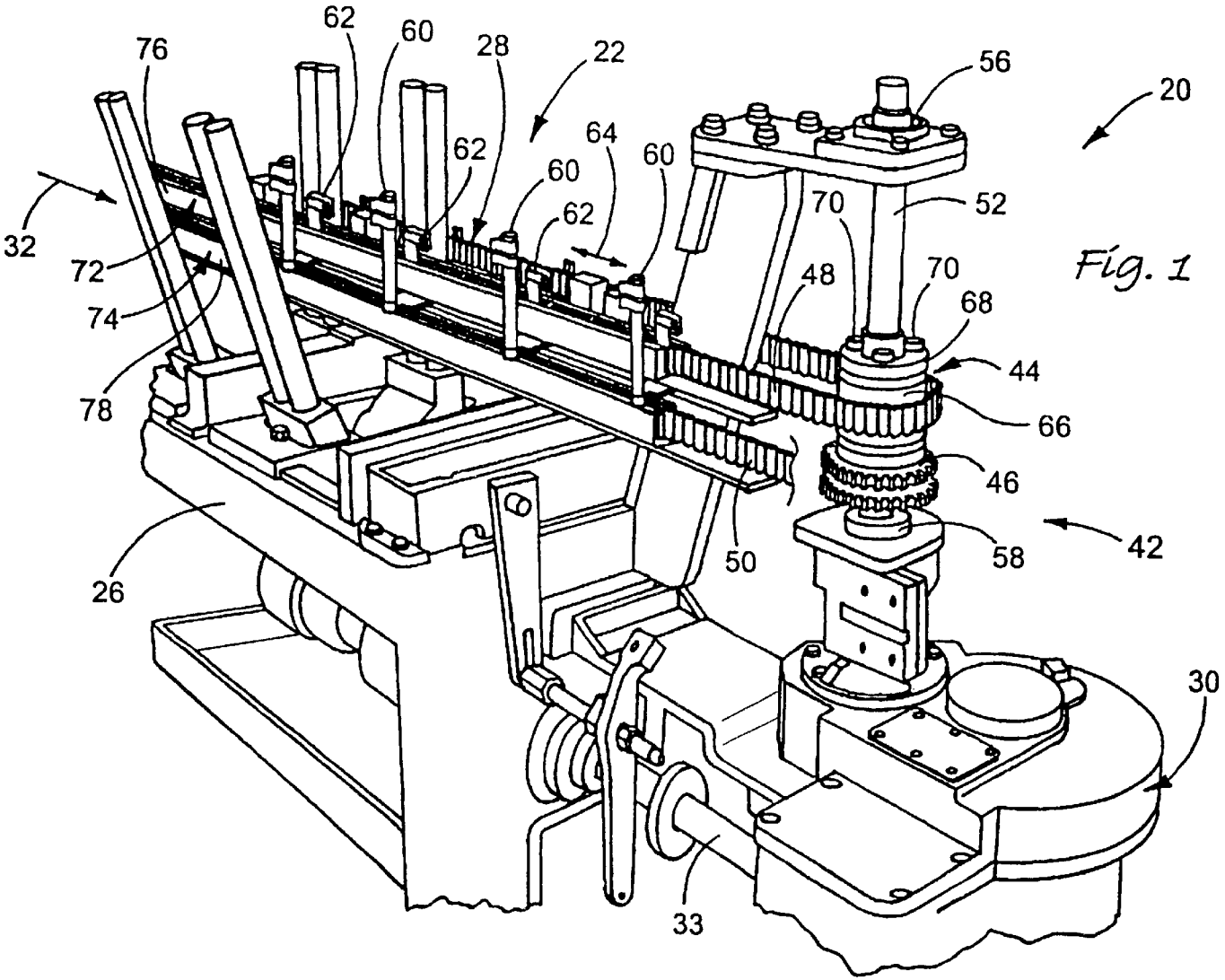
FIG. 1 is a fragmentary perspective view of one end of a packaging machine incorporating an adjustable endless carrier in accordance with a preferred embodiment of the present invention.
Figure 2:
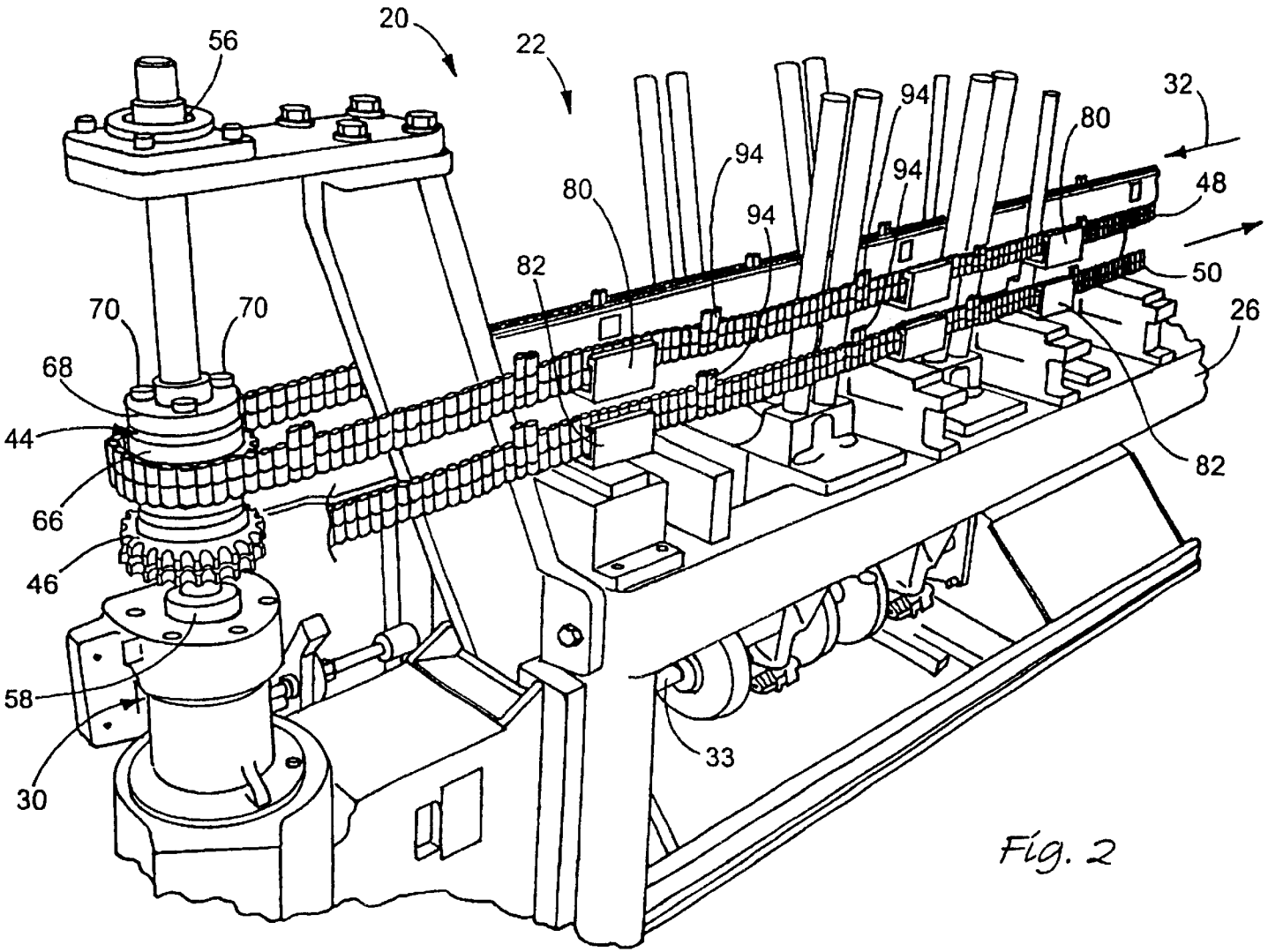
FIG. 2 is a different perspective view of the same end of the packaging machine illustrated in FIG. 1.
Figure 3:
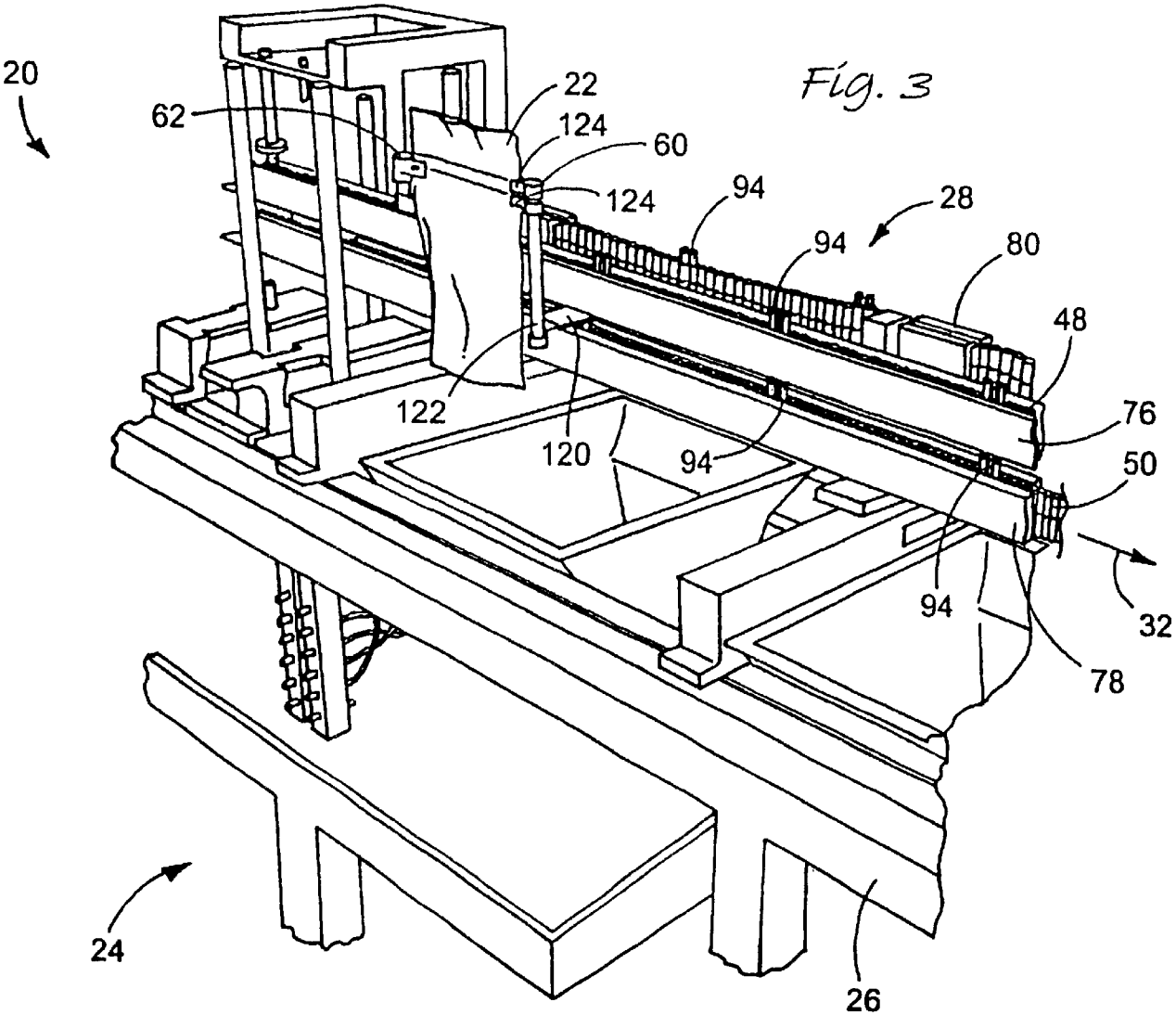
FIG. 3 is a fragmentary perspective view of another portion of the packaging machine illustrated in FIG. 1.
Figure 4:
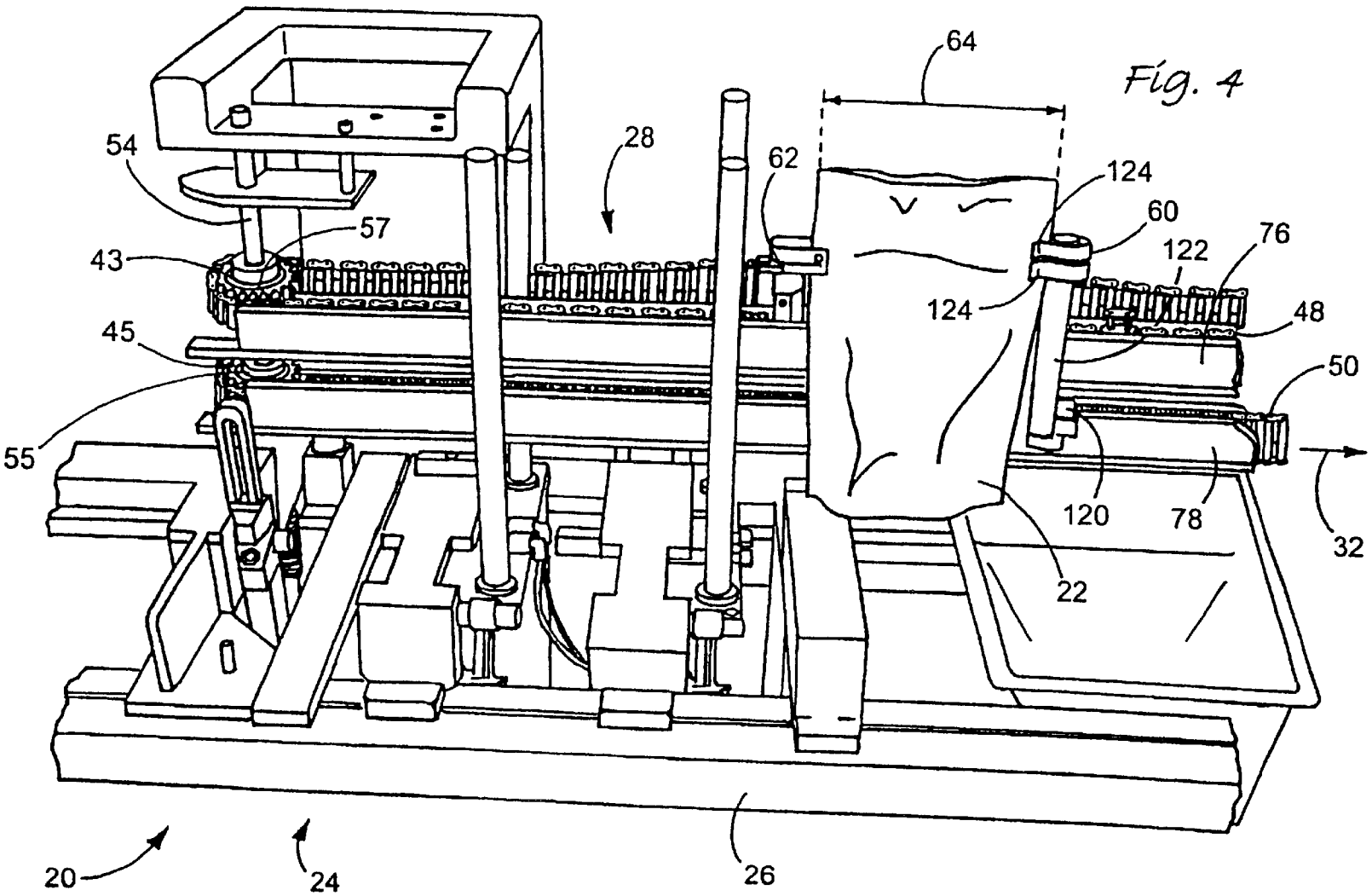
FIG. 4 is a fragmentary perspective view of the other end of the packaging machine illustrated in FIG. 1.

As shown in FIGS. 2–4 in which certain clamps are not illustrated, the lower and upper endless chains 48, 50 include mounting posts 94 which extend vertically above the respective chain guides 82, 84 to which the clamps mount. The mounting posts 94 are located at spaced intervals around the endless chains so that the clamps are located at spaced intervals as well.

Figure 14:
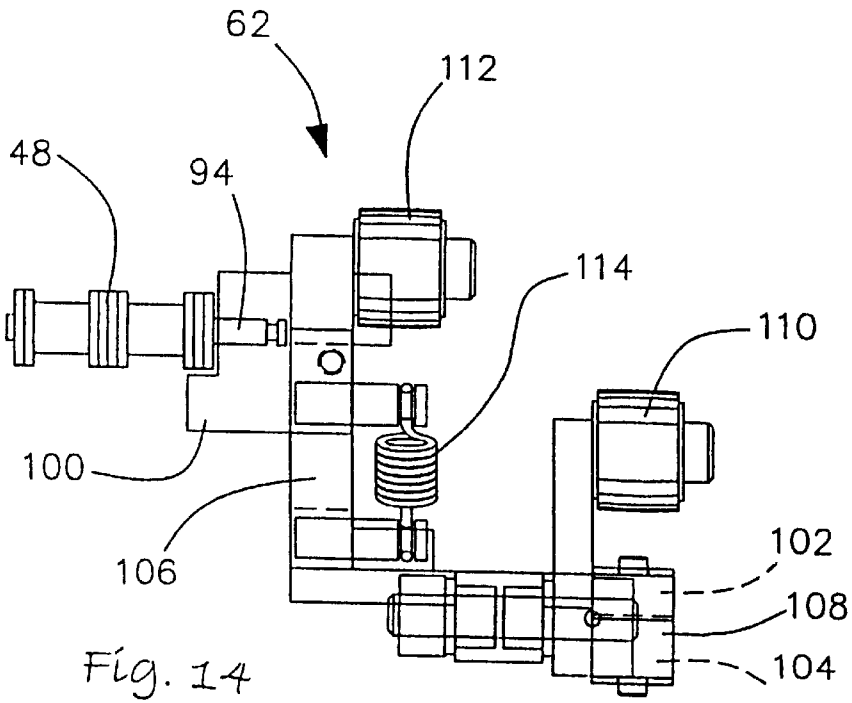
FIGS. 13–15 are top, end and side views of a trailing clamp used in the packaging machine of FIG. 1.
Figure 13:
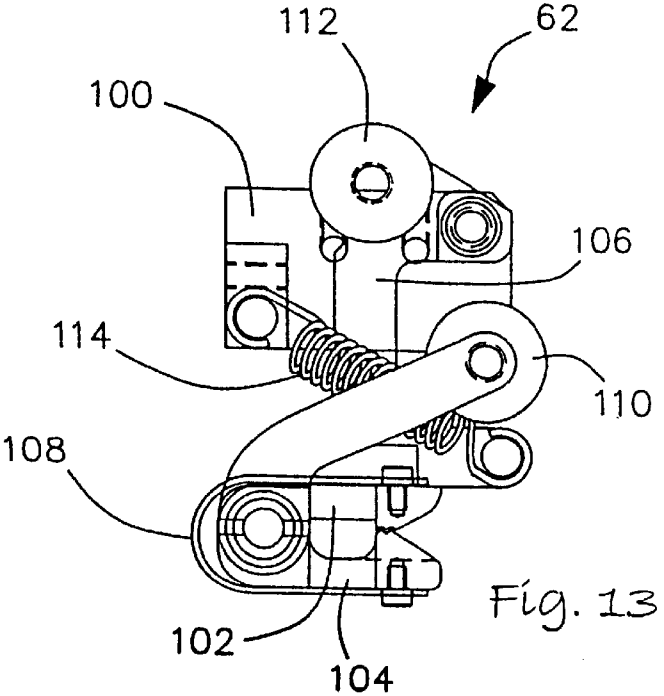
Figure 17:
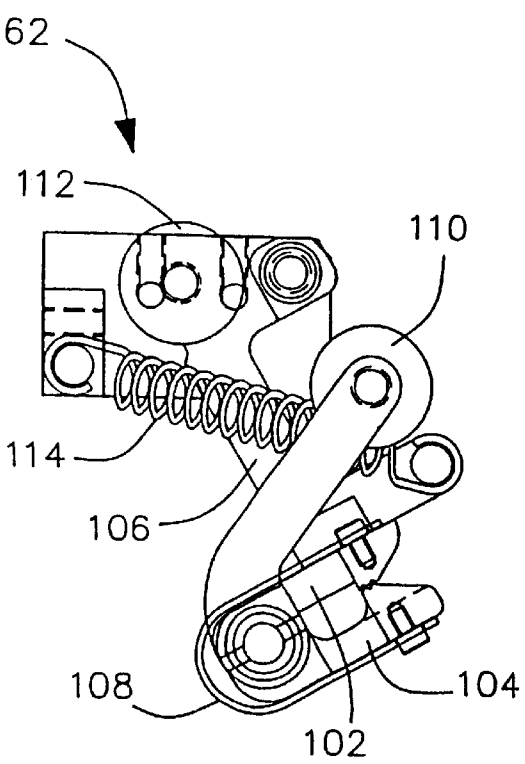
FIGS. 16–17 are alternative positions of the trailing clamp illustrated in FIG. 13.
Figure 16:
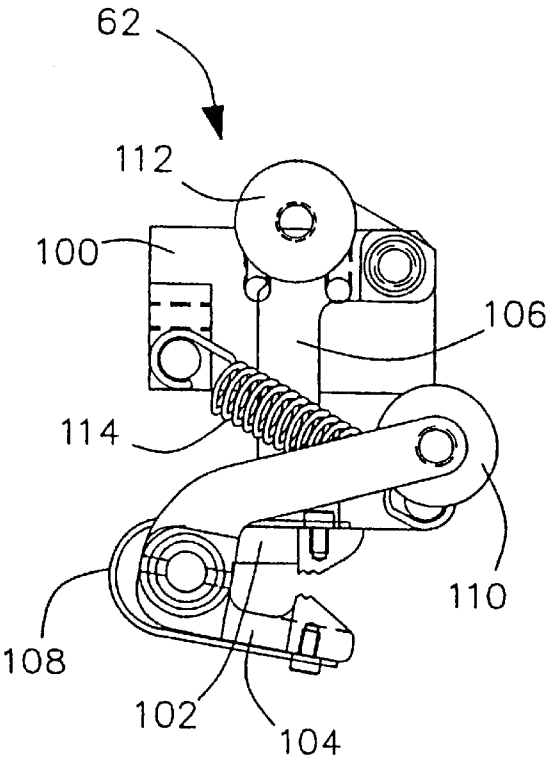
Figure 15:
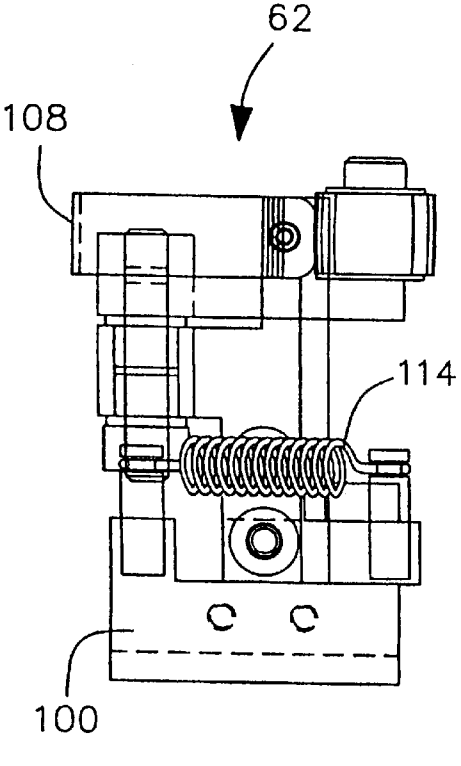

Referring in greater detail to the clamps 60, 62 of the preferred embodiment with reference to FIGS. 13–15 illustrating an exemplary trailing clamp, it is seen that the trailing clamp includes a base 100 that mounts to the posts 94. The base 100 carries a pair of jaws 102, 104 which are pivotable relative to the base 100, via an arm 106. The jaws 102, 104 are pivotable relative to each other and biased towards each other by a spring clip 108 surrounding the jaws 102, 104. The movement of the jaws 102, 104 is controlled by two followers 110, 112 which are adapted to engage surfaces for actuating and controlling the position of the jaws 102, 104. A coil spring 114 biases the arm 106 towards a rest position. The inside jaw 102 is fixed to the arm 106 while the outside jaw 104 is movable with respect thereto. Upon proper actuation of the first follower 110, the outside jaw 104 is urged away from the inside jaw 102 against the action of the spring clip 108 such that the jaws 102, 104 are opened to a pick position as shown in FIG. 16 to receive an edge of a pouch therein. The pick position is utilized at the pick station 34 (FIGS. 5–9) to pick new unfilled pouches from a pouch supply. Once the edge of the pouch is between the opened jaws 102, 104, the first follower 110 is released to allow the spring clip 108 to close the jaws 102, 104 and pinch the pouch edge therebetween. At this point the pouch is closed. To assist in opening the pouch by providing slack in the pouch, the second follower 112 is actuated against the action of the coil spring 114 which pushes the arm 106 and the pair of jaws 102, 104 forward toward the leading clamp 60 as shown in FIG. 17. This shortens the distance between leading and trailing clamps 60, 62 and provides sufficient slack in the pouch such that the pouch remains open for filling operations (see reference number 36 in FIG. 5).

Turning to further details of the leading clamp 60, it includes a base member 120 mounted to the mounting posts 94. The base member 120 projects beyond the periphery of the chain guides 76, 78 to support an upright arm 122 which projects vertically to the elevation at which the jaws 102, 104 of the trailing clamp 62 are located. Near the top end of the arm 122 at a similar elevation as the jaws 102 104, resilient clips 124 are provided which are adapted to be opened to receive an edge of a pouch and closed to pinch the pouch in order to hold the edge of the pouch. The leading clamp 60 works cooperatively with the trailing clamp 62 to support a pouch.

In accordance with another aspect of the present invention, the present invention may be incorporated in a newly built machine or be incorporated in a retrofit kit for retooling a machine. There are a number of old packaging machines existing to which the present invention can be incorporated into to provide various features of the present invention. Some such exemplary packaging machines that may be retrofitted with a kit that incorporates the present invention are those disclosed in some of the patents mentioned herein and any other acceptable packaging machines. Advantageously, this salvages various expensive components of a packaging machine, such as the cycle shaft including the cams thereon, much or all of the various machinery of the stations if so desired, much or all of the intermittent drive mechanism, and the basic support frame upon which the packaging machine is built. It will be understood that the retrofit kit can be used to build the packaging machine 20 that is shown in the various figures.

In the preferred embodiment, the retrofit kit at least comprises the endless carrier 28 which includes the upper and lower sprockets 43–46, the upper and lower endless chains 48, 50, and leading and trailing clamps 60, 62 individually connected to the respective chains which are used to replace the endless carrier existing on the machine. The kit also includes new upper and lower chain guides 72, 74 along with the support trees 88 to affix the guides 72, 74 to the support frame 26. To properly affix and support the sprockets 43–46, new support shafts 52, 54 are also typically provided as part of the retrofit kit. Because of the vertical sprocket spacing needed on the support shafts 52, 54 the retrofit kit may include additional support extension arms 130 affixed to the support frame 26 near respective ends of the machine 20 to journal the upper ends of the drive shaft 52 in upper bearings 56 thereby to more evenly carry the loads of the endless carrier 28.

Figure 18:
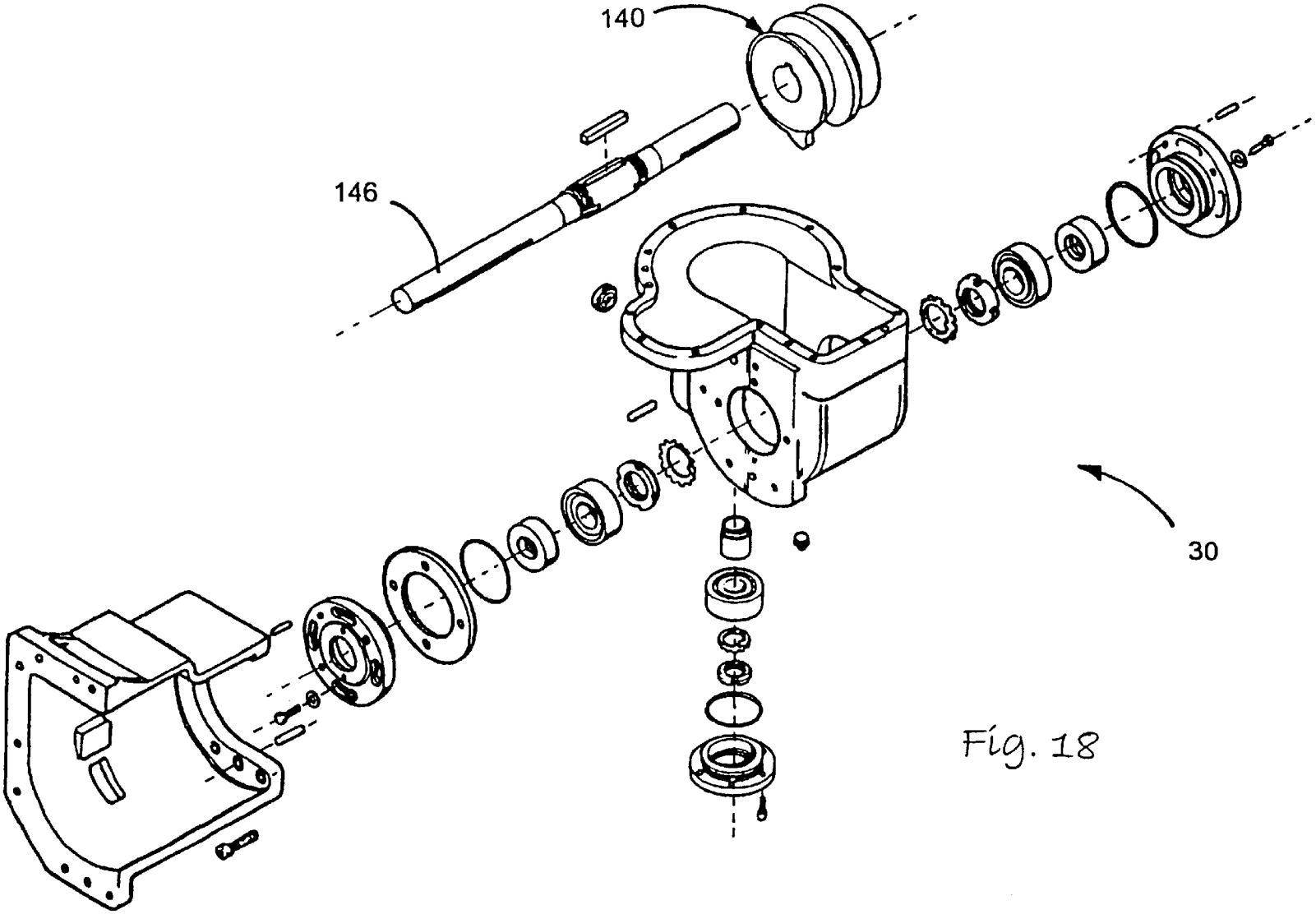
FIGS. 18 and 19 are exploded parts diagrams of an exemplary intermittent drive mechanism used in the packaging machine of FIG. 1.
Figure 19:
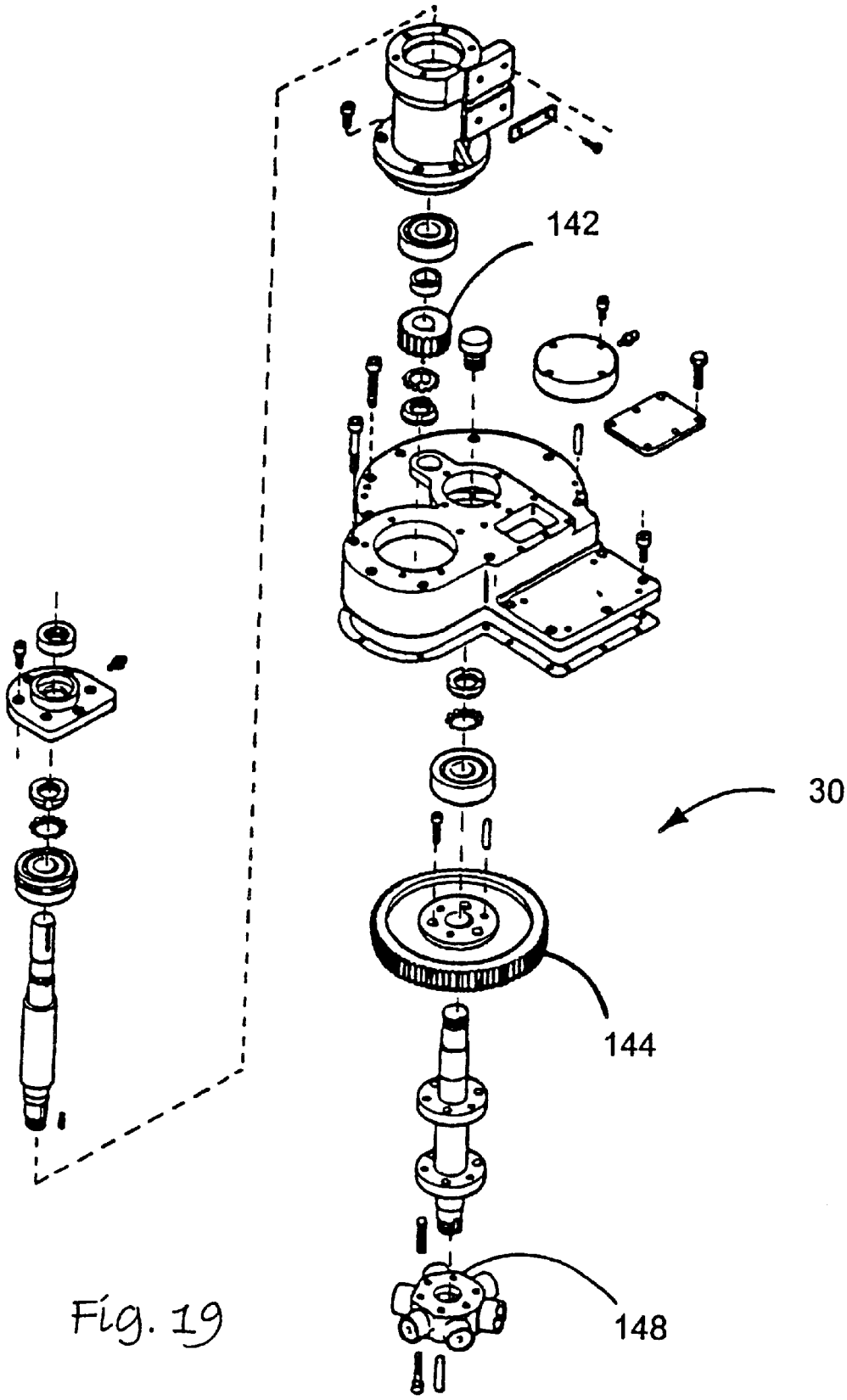

As previously mentioned much or all of the intermittent drive mechanism 30 is salvaged when retrofitting the machine. However, it is advantageous to modify internal mechanics in the intermittent drive mechanism 30 to optimize the dwell time and index time, thereby to maintain a rate of advance for the pouches that keep operational production rates high. Accordingly, the internal drive components of a prior intermittent drive mechanism 30 are illustrated in FIGS. 18–19 with the exception of the configuration of the cam 140 and the configuration of the gears 142, 144 as will be explained in further detail below. The drive mechanism 30 includes an input shaft 146 to which the cam 140 is affixed. The input shaft 146 is coupled to the cycle shaft 33 (FIG. 1) such that the cam 140 is continuously driven during operation. The cam 140 drives a spider 148 which includes six cam followers such that an output shaft 52 is driven a sixth of a revolution for every revolution of the cycle shaft 33. The large gear 144 is connected on the end of the output shaft and directly drives the smaller gear 146 which in turn is coupled to the drive shaft 52 (FIG. 1) to drive the endless carrier 28.

To maintain high production rates of the packaging machine, the cam 140 and the gears 142, 144 are also preferably replaced. Specifically, a higher phase cam 140 is provided which increases the index phase from between 120–150° as per the prior art to an index phase 180° or more. This means that for every rotation of the cycle shaft 33 the cam is mobilizing or indexing the cam followers or spider 148 (thereby indexing the endless carrier 28) for 180° of the movement of the cycle shaft 33 and not engaging the cam followers or spider 148 (thereby maintaining the endless carrier 28 in a dwell position) for the other 180° of the movement of the cycle shaft 33. Increasing the cam index phase maintains a high production rate for the retrofitted packaging machine. The gear ratio of the gears 142, 144 are also replaced to control the distance the endless carrier 28 moves during each index. Specifically, the gear ratio of the gears 142, 144 is predetermined to select an upper or maximum width size of pouch that can be used by the packaging machine. For example, if it is desired to provide a machine capable of utilizing pouches having a width size of anywhere between 4 inches and 7.75 inches, it has been found that a 10 inch movement is desired to provide enough space to accommodate the clamps and spacing between pouches. Accordingly, the gears are sized for the maximum movement and fix the movement for all pouch sizes at 10 inches. To accomplish this, the large and small gears 142, 144 are of the 10 inch pitch type and the large gear 144 has 100 teeth while the small gear 142 has 20 teeth. To summarize, new gears and a new cam is provided to match the intermittent drive mechanism to a predetermined index distance and index and dwell times.

Figure 20:
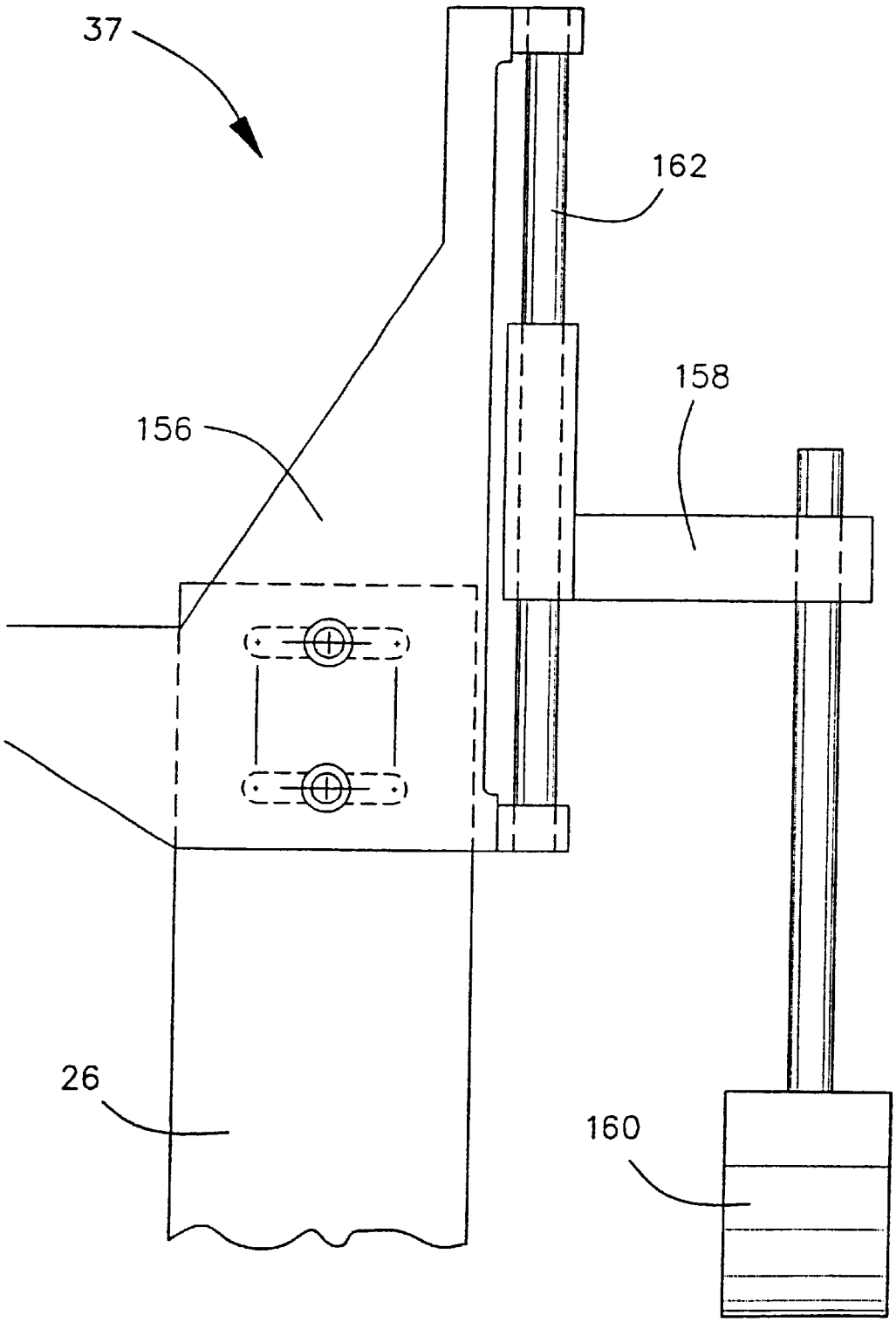
FIG. 20 is an exemplary wedge opening station for use with a packaging machine according to a preferred embodiment.

To also maintain high rates of production, the sequence or configuration of the stations may also be changed. For example, vacuum machinery which pulls the sides of the pouches at the filling station 38 may be removed and replaced with a wedge opening station 37 located upstream of the filling station. A partly schematic illustration of the machinery used at the wedge opening station 37 is shown in FIG. 20. The machinery includes a bracket 156 which mounts on the support frame 26 that carries a wedge carriage 158 which includes a wedge 160 for forming a pocket in the pouch 22 prior to filling as schematically indicated by reference numeral 37 in FIG. 5. The carriage 158 is slidable and linearly translatable on guide rods 162 to move into and out of pouches. The carriage 158 is driven by the cycle shaft 33 in a conventional cycle such that the wedge 160 is driven into the pouch during the dwell time to form an opening or pocket therein. By eliminating the vacuuming step at the fill station 38, the minimum required dwell time is reduced thereby allowing for an increase in packaging production.

All of the references cited herein, including patents, patent applications and publications are hereby incorporated in their entireties by reference. While this invention has been described with an emphasis upon preferred embodiments, it will be obvious to those of ordinary skill in the art that variations of the preferred embodiments may be used and that it is intended that the invention may be practiced otherwise than as specifically described herein. Accordingly, this invention includes all modifications encompassed within the spirit and the scope of the invention as defined by the following claims.

What is claimed is:

1. In a packaging machine including an intermittent drive mechanism that intermittently advances pouches along a path to fill the pouches with material, a pouch carrier comprising:

first and second support shafts for rotation relative thereto, at least one of the shafts being a drive shaft drivingly connected to the intermittent drive mechanism;

sets of upper and lower sprockets, one upper sprocket and one lower sprocket carried by each support shaft, the sprockets adapted to be secured thereto so that the sprockets are driven in unison by the intermittent drive mechanism;

upper and lower endless chains entrained around the sets of upper and lower sprockets, respectively;

a plurality of pairs of leading and trailing clamps located at spaced intervals along the endless chains, the leading clamps being attached to one endless chain and the trailing clamps being attached to the other, the leading and trailing clamps of each pair being selectively spaced apart for holding pouches therebetween; and an adjustment mechanism adapted to selectively adjust the positions of the endless chains relative to one another to control the spacing between adjacent leading and trailing clamps.

2. The invention of claim 1 wherein at least one of the sprockets secured to the drive shaft is a phase sprocket capable of being released from the shaft, rotated relative to the shaft and resecured to the shaft, to control the selective spacing between leading and trailing clamps and thereby provide the adjustment mechanism.

3. The invention of claim 2 wherein the at least one phase sprocket is selectively fastened to a fixed hub that is fixed to the shaft, the phase sprocket defining teeth and capable of being rotated relative to the fixed hub, and means for selectively releasing and refastening the phase sprocket to the fixed hub.

4. The invention of claim 1 wherein at least one of the pluralities of leading clamps and trailing clamps includes jaws movable relative to the endless chain adapted to shorten the distance between leading and trailing clamps for producing slack in the pouch to assist in opening the pouch.

5. The invention of claim 4 wherein the packaging machine includes a plurality of packaging stations arranged along the path of the endless chains, including in sequence:

a pick station for picking pouches from a pouch supply;

a pouch opening station adapted to open pouches, the pouch opening station producing relative movement between the leading and trailing clamps and thereafter inserting a wedge into the pouch to form an opening therein;

a fill station adapted to fill pouches with material:

a closing station adapted to closed the filled pouches; and a sealing station adapted to seal the closed pouches.

6. The invention of claim 1 wherein the pouch carrier is a retrofit kit installed on a pre-existing packaging machine in which the drive mechanism intermittently advances the pouches an index distance over an index period and allows the pouches to dwell for packaging operations over a dwell period, further comprising new gearing components added to the intermittent drive mechanism matched to a predetermined index distance, a predetermined index period and a predetermined dwell period for the retrofitted packaging machine.

7. The invention of claim 1 further comprising upper and lower chain guides supporting the upper and lower endless chains, respectively, the chain guides being continuous throughout a plurality of packaging stations on the pouch path of the pouch carrier to adequately support the leading and trailing clamps in upright positions.

8. The invention of claim 7 wherein the upper and lower chains guides are discontinuous and broken up into a plurality of spaced apart segments on a return side of the endless chains.

9. In a packaging machine including a support frame and a drive mechanism that advances pouches along a path to fill the pouches with material, a pouch carrier comprising:

sets of upper and lower sprockets, one upper sprocket and one lower sprocket carried by the support frame for rotation relative to the support frame, one of the upper sprockets and one of the lower sprockets being drivingly connected to the drive mechanism whereby the sprockets are driven in unison by the drive mechanism;

upper and lower endless chains entrained around the sets of upper and lower sprockets, respectively;

a plurality of pairs of leading and trailing clamps at spaced locations along the endless chains, the leading clamps being attached to one endless chain and the trailing clamps being attached to the other, the leading and trailing clamps of each pair being selectively spaced apart for holding pouches therebetween; and wherein the positions of the endless chains relative to one another are adjustable to control the spacing between clamps.

10. The pouch carrier of claim 9 further comprising a drive shaft connecting the drive mechanism to the sprockets.

11. The invention of claim 10 wherein at least one of the sprockets secured to the drive shaft is a phase sprocket capable of being released from the shaft, rotated relative to the shaft and resecured to the shaft, to control the selective spacing between leading and trailing clamps.

12. The invention of claim 11 wherein the at least one phase sprocket is selectively fastened to a fixed hub that is fixed to the shaft, the phase sprocket defining teeth and capable of being rotated relative to the fixed hub, and means for selectively releasing and refastening the phase sprocket to the fixed hub.

13. The invention of claim 9 wherein at least one of the pluralities of leading clamps and trailing clamps includes jaws movable relative to the endless chain adapted to shorten the distance between leading and trailing clamps for producing slack in the pouch to assist in opening the pouch.

14. The invention of claim 13 wherein the packaging machine includes a plurality of packaging stations arranged along the path of the endless chains, including in sequence:

a pick station for picking pouches from a pouch supply;

a pouch opening station adapted to open pouches, the pouch opening station producing relative movement between the leading and trailing clamps and thereafter inserting a wedge into the pouch to form an opening therein;

a fill station adapted to fill pouches with material;

a closing station adapted to closed the filled pouches; and a sealing station adapted to seal the closed pouches.

15. The invention of claim 9 wherein the pouch carrier is a retrofit kit installed on a pre-existing packaging machine.

16. The invention of claim 15 wherein the drive mechanism is of the intermittent type for intermittently advancing the pouches an index distance over an index period and allowing the pouches to successively dwell for packaging operations over a dwell period, and further comprising new gearing components added to the intermittent drive mechanism matched to a predetermined index distance, a predetermined index period and a predetermined dwell period for the retrofitted packaging machine.

17. The invention of claim 9 further comprising upper and lower chain guides supporting the upper and lower endless chains, respectively, the chain guides being continuous throughout a plurality of packaging stations on the pouch path of the pouch carrier to adequately support the leading and trailing clamps in upright positions.

18. The invention of claim 17 wherein the upper and lower chains guides are discontinuous and broken up into a plurality of spaced apart segments on a return side of the endless chains.

* * * * *